US009711275B2

(12) United States Patent
Jain

(10) Patent No.: US 9,711,275 B2
(45) Date of Patent: Jul. 18, 2017

(54) EXTERNALLY MOUNTED FUSE BOX ON A LIQUID-FILLED TRANSFORMER AND METHOD FOR SERVICING

(71) Applicant: Virginia Transformer Corporation, Roanoke, VA (US)

(72) Inventor: Prabhat Jain, Roanoke, VA (US)

(73) Assignee: Virginia Transformer Corporation, Roanoke, VA (US)

( * ) Notice: Subject to any disclaimer, the term of this patent is extended or adjusted under 35 U.S.C. 154(b) by 177 days.

(21) Appl. No.: 14/606,653

(22) Filed: Jan. 27, 2015

(65) Prior Publication Data

US 2016/0217941 A1 Jul. 28, 2016

(51) Int. Cl.

| | |
|---|---|
| ***H01H 9/02*** | (2006.01) |
| ***H01F 27/40*** | (2006.01) |
| ***H01H 85/00*** | (2006.01) |
| ***H01H 85/02*** | (2006.01) |
| *H01H 85/22* | (2006.01) |

(52) U.S. Cl.

CPC ..... *H01F 27/402* (2013.01); *H01H 85/0026* (2013.01); *H01H 85/0241* (2013.01); *H01H 85/22* (2013.01); *H01H 2009/0292* (2013.01); *H01H 2085/0291* (2013.01)

(58) Field of Classification Search

CPC ..... H01F 27/402; H01H 85/0026; H01H 85/0241; H01H 2085/0291; H01H 85/22; H01H 2009/0292

USPC ..... 337/204

See application file for complete search history.

(56) References Cited

U.S. PATENT DOCUMENTS

| | | | | |
|---|---|---|---|---|
| 3,916,258 | A * | 10/1975 | Westrom | H02H 5/06 337/208 |
| 3,953,818 | A * | 4/1976 | Martin | H01F 27/402 337/191 |
| 3,990,031 | A * | 11/1976 | Benton | H01F 27/04 337/186 |
| 4,002,949 | A | 1/1977 | Westrom | |
| 4,523,253 | A | 6/1985 | Grünberg et al. | |
| 4,975,797 | A * | 12/1990 | Veverka | H01F 27/04 361/127 |
| 5,204,654 | A | 4/1993 | Hay | |

(Continued)

FOREIGN PATENT DOCUMENTS

| | | |
|---|---|---|
| CN | 2833829 Y | 11/2006 |
| CN | 202503206 U | 10/2012 |

(Continued)

OTHER PUBLICATIONS

FR/2782418, Sep. 15, 2000, English machine translation.*

*Primary Examiner* — Anatoly Vortman
(74) *Attorney, Agent, or Firm* — Maier & Maier, PLLC

(57) ABSTRACT

A fuse box mounted on a liquid-filled transformer is disclosed. The fuse box may include one or more fuse link assemblies securing one or more fuses within a base fuse box, a fuse holder coupling the one or more fuse link assemblies within the base fuse box, wherein the one or more fuse link assemblies are pulled-up from the fuse holder by hand to remove the one or more fuse link assemblies from the base fuse box. The fuse box may include a retaining ring to fasten the fuse holder to the one or more fuse link assemblies. The fuse box may include a method for servicing a fuse box on a liquid-filled transformer.

7 Claims, 6 Drawing Sheets

(56) References Cited

U.S. PATENT DOCUMENTS

| | | | | |
|---|---|---|---|---|
| 5,594,403 | A * | 1/1997 | Taga | H01H 85/20 337/186 |
| 5,982,267 | A * | 11/1999 | Locht | H01H 85/20 337/186 |
| 6,737,578 | B2 | 5/2004 | Higuchi | |
| 7,142,410 | B2 * | 11/2006 | Norris | H01F 27/02 174/50 |
| 7,548,148 | B2 | 6/2009 | Kersten | |
| 8,345,393 | B1 | 1/2013 | Martinez et al. | |
| 8,692,645 | B2 * | 4/2014 | Ciesielski | H01F 27/402 337/142 |
| 9,035,739 | B2 * | 5/2015 | Boe | H01H 85/0021 337/186 |
| 9,508,517 | B2 * | 11/2016 | Breili | H01H 85/0021 |
| 2004/0007374 | A1 | 1/2004 | Higuchi | |
| 2006/0187574 | A1 | 8/2006 | Kersten | |
| 2012/0133479 | A1 | 5/2012 | Ciesielski | |
| 2012/0281321 | A1 | 11/2012 | Ciesielski et al. | |

FOREIGN PATENT DOCUMENTS

| | | | | |
|---|---|---|---|---|
| FR | 2782418 | B1 * | 9/2000 | H02B 7/06 |
| KR | 100740913 | B1 | 12/2007 | |
| KR | 101055329 | B1 | 8/2011 | |

* cited by examiner

EXTERNALLY MOUNTED FUSE BOX ON A LIQUID-FILLED TRANSFORMER AND METHOD FOR SERVICING

BACKGROUND

Liquid-filled transformers operate with current limiting fuses for protection. The fuses are mounted inside the liquid-filled tank and submerged in the liquid. In the event of a fuse failure, the transformer liquid is contaminated with carbon and other waste particles. Replacing the fuses is expensive and takes many days due to the nature of the liquid-filled transformers.

In order to replace fuses in a liquid-filled transformer, the transformer itself must be disassembled. The disassembly process involves waiting for the transformer to cool down, using a crane to remove the cover of the transformer and then extracting the core/coil of the transformer. Additionally typically several thousand gallons of transformer fluid that have become contaminated have to be drained, stored, transported, and disposed of accordingly. Then, in order to restore the transformer to functional status, a number of steps also have to be performed. The tank of the transformer must be cleaned and appropriately inspected. The core/coil have to be placed back inside the tank and then the fuses have to be replaced. Next replacement fluid must be transported to the transformer and used to refill the transformer. The cover of the transformer must then be reinstalled. Therefore, in the event one or more fuses blows in a current liquid-filled transformer, there are typically several days of labor involved in the inefficient and expensive process of replacing the fuses.

SUMMARY

In one exemplary embodiment, a fuse box mounted on a liquid-filled transformer may be described. The fuse box may be externally mounted and may provide an efficient and inexpensive servicing option when one or more fuses are blown. As the fuses may be located external to the liquid-filled transformer, liquid or oil inside the transformer tank may be uncontaminated, therefore eliminating disassembling, restoring and inspection processes within the liquid-filled transformer tank. The fuse box can be liquid-filled and may only have a small fraction of the liquid replaced compared to the liquid in the entire transformer tank. By mitigating the risk of exposing the transformer liquid to contamination, the life of the transformer is extended by eliminating the need to refurbish the sealed transformer tank.

In one exemplary embodiment, a fuse box mounted on a liquid-filled transformer, may be shown and described which allow for efficient servicing of a liquid-filled fuse box. There may be a base fuse box may be mounted on a liquid-filled transformer. The fuse box may further have a fill plug removably inserted into a fill aperture disposed on a top portion of the base fuse box; a fill coupling disposed between the fill plug and the fill aperture, the fill coupling couples the fill plug into the fill aperture, the fill aperture receives fluid poured into the base fuse box and an outlet aperture allows fluid to exit from the base fuse box, the outlet aperture is plugged with a drain plug; a fuse holder disposed within a bottom interior portion of the base fuse box; and one or more fuses secured within the base fuse box. The fuse box may further include one or more fuse link assemblies that secure the one or more fuses within the base fuse box, the fuse holder coupling the one or more fuse link assemblies within the base fuse box, wherein the one or more fuse link assemblies are pulled upwards from the fuse holder to remove the one or more fuse link assemblies from the base fuse box; a gasket sealing an opening where the fuse holder is disposed; and a fuse box cover disposed in front of the gasket, the fuse box cover and the gasket coupled to a fuse box frame to cover inside the base fuse box, the fuse box cover and the gasket are coupled to the fuse box frame with a plurality of fasteners.

Another exemplary embodiment may show and describe a fuse box externally mounted on a liquid-filled transformer with a holder that couples the fuse box to a tank wall on the liquid-filled transformer. This embodiment may include a base fuse box mounted on the liquid-filled transformer; a fill plug removably inserted into a fill aperture disposed on a top portion of the base fuse box; and a fill coupling disposed between the fill plug and the fill aperture, the fill coupling couples the fill plug into the fill aperture, the fill aperture receives fluid poured into the base fuse box and an outlet aperture allows fluid to exit from the base fuse box, the outlet aperture is plugged with a drain plug. The exemplary embodiment may further have a fuse holder disposed within a bottom interior portion of the base fuse box; one or more fuses secured within the base fuse box; and one or more fuse link assemblies securing the one or more fuses within the base fuse box, the fuse holder coupling the one or more fuse link assemblies within the base fuse box, wherein the one or more fuse link assemblies are pulled up from the fuse holder to remove the one or more fuse link assemblies from the base fuse box, wherein the one or more fuse link assemblies include a middle fuse link assembly and a pair of end fuse link assemblies, wherein the middle fuse link assembly is flipped upside-down between the pair of end fuse link assemblies disposed in an upright position, wherein the one or more fuses are removed from the removed one or more fuse link assemblies outside of the base fuse box to change the one or more fuses. Additionally, the exemplary embodiment can include a gasket sealing an opening where the fuse holder is disposed; a fuse box cover disposed in front of the gasket, the fuse box cover and the gasket coupled to a fuse box frame to cover inside the base fuse box, the fuse box cover and the gasket are coupled to the fuse box frame with a plurality of fasteners; and a retaining ring to fasten the fuse holder to the one or more fuse link assemblies.

In another exemplary embodiment, a method for replacing fuses associated with a liquid-filled transformer may be described. The method may include mounting a liquid-filled fuse box on a liquid-filled transformer; draining liquid through an orifice on a bottom of the fuse box mounted on the liquid-filled transformer; opening a front cover of the fuse box and cleaning an inside surface of the fuse box; replacing one or more fuses of the fuse box; and replacing the front cover and refilling the fuse box of the liquid-filled transformer with fresh liquid through an opening on a top of the fuse box.

BRIEF DESCRIPTION OF THE DRAWINGS

Advantages of embodiments of the present invention will be apparent from the following detailed description of the exemplary embodiments thereof, which description should be considered in conjunction with the accompanying drawings in which like numerals indicate like elements, in which.

DETAILED DESCRIPTION

Aspects of the present invention are disclosed in the following description and related figures directed to specific embodiments of the present invention. Those skilled in the art will recognize that alternate embodiments may be devised without departing from the spirit or the scope of the claims. Additionally, well-known elements of exemplary embodiments of the present invention will not be described in detail or will be omitted so as not to obscure the relevant details of the present invention.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the present invention", "embodiments" or "present invention" do not require that all embodiments of the present invention include the discussed feature, advantage, or mode of operation.

Referring generally to exemplary FIGS. 1-6, embodiments showing methods and apparatuses for mounting fuse boxes to transformers and servicing fuse boxes mounted onto such transformers may be shown and described. The methods and apparatuses described herein may provide for efficient servicing of such items and prevent undesired down time of the transformers.

Figure 1:
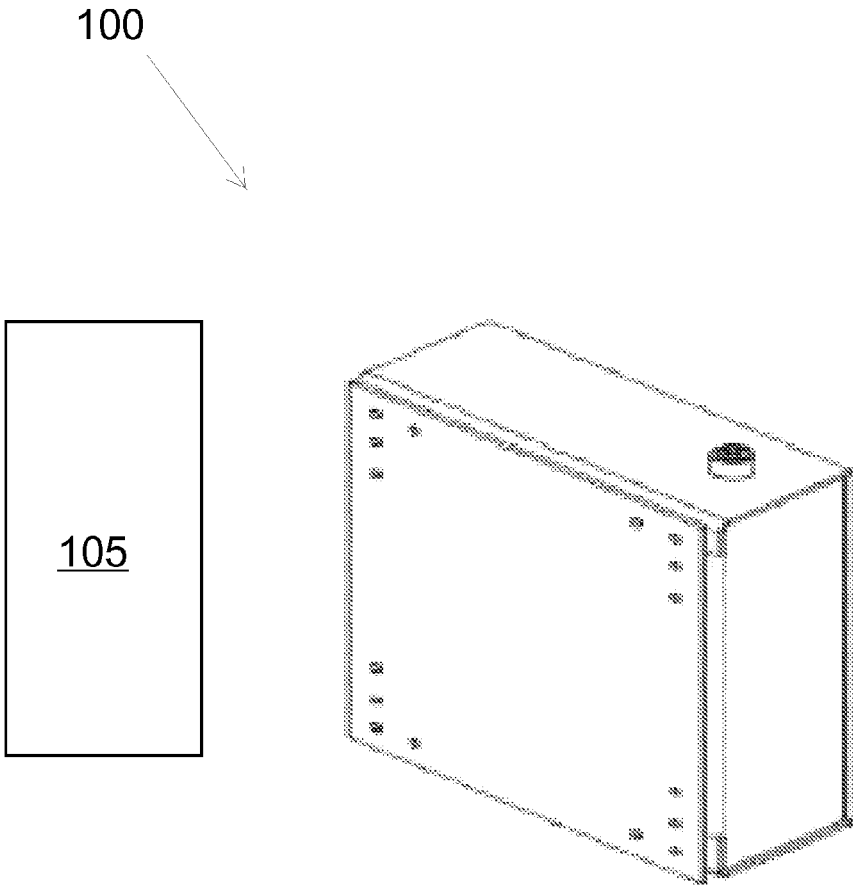
FIG. 1 is an exemplary diagram showing a fuse box to be mounted on a liquid-filled transformer.

FIG. 1 provides an exemplary diagram showing a fuse box 100 to be mounted on a liquid-filled transformer 105. The fuse box 100 may be externally mounted on a liquid-filled transformer 105 and may be the only item to be serviced in the event of a failure of the liquid-filled transformer 105. Liquid-filled transformer 105 may be filled with any desired liquid, for example, but not limited to, transformer oil or insulating oil.

The liquid or oil inside the transformer 105 tank may be uncontaminated following a fuse blowing, or any other problem or failure occurring in the fuse box 100. As the fuse box 100 is mounted on an external portion of transformer 105, and there may not be a conduit or any other manner of fluid from the fuse box 100 interacting with or commingling with fluid from the transformer 105, failures in the fuse box 100 that can create impurities or cause contamination of the liquid housed therein may not be imputed or shared with the liquid inside transformer 105. This, in turn, can eliminate time consuming and expensive steps of disassembling, restoring and inspecting within the liquid-filled transformer 105 tank. Additionally, the fuse box 100 can be liquid-filled and may only need a small fraction of the liquid replaced compared to the liquid in the entire transformer 105 tank. By mitigating the risk of exposing the transformer liquid to contamination, the life of the transformer 105 may be extended by significantly reducing the need to refurbish the sealed transformer 105 tank.

Figure 2:
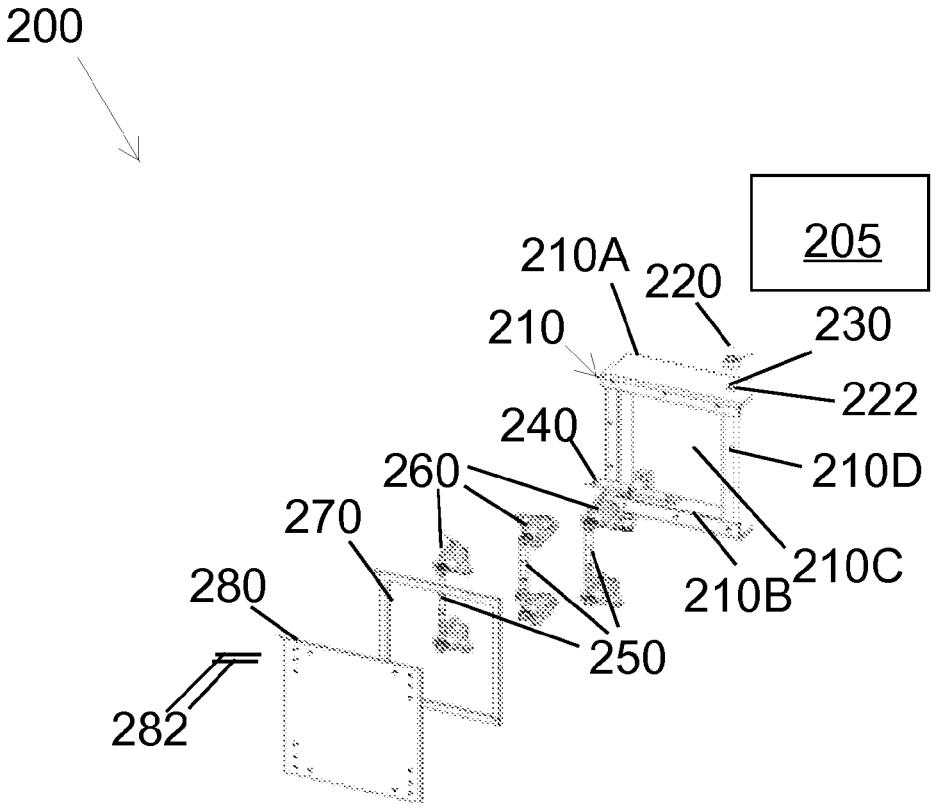
FIG. 2 is an exemplary diagram showing an exploded view of a fuse box mounted on a liquid-filled transformer.

FIG. 2 is an exemplary diagram showing an exploded view of a fuse box 200 mounted on a liquid-filled transformer 205.

The fuse box 200 in exemplary FIG. 2 may include a base fuse box 210, a fill plug 220, a fill coupling 230, a fuse holder 240, one or more fuses 250, one or more fuse link assemblies 260, a square gasket 270, and a fuse box cover 280, as well as any other desired components.

The base fuse box 210 may be mounted on a liquid-filled transformer 205. The mounting of the base fuse box 210 may be accomplished in any desired fashion. For example, one or more traditional mounts or fasteners could be used, durable adhesives may be utilized, or any combination of mounts, fasteners, and adhesives can be used. Additionally, it may be appreciated that any components of the base fuse box 210 that may be connected with any internal components of the liquid-filled transformer 205 may be passed through a wall of the base fuse box 205 and a wall of the liquid-filled transformer 205 in such a way as to preserve and ensure that there is no cross-contamination of fluids between the base fuse box 210 and the liquid-filled transformer 205. The fill plug 220 may be removably inserted into a fill aperture 222 that may, for example, be disposed or located on a top portion 210A of the base fuse box 210 to contain a liquid housed within the base fuse box 210. The positioning of aperture 222 may be such that it may be easily accessible and provide for ease of pouring of a liquid into fuse box 200. Additionally, the term 'removably inserted' can be defined, in this exemplary embodiment, as having the capability to insert and remove the fill plug 220 into the fill aperture 222. However, it may further be appreciated that fill plug 220 may be securely inserted into the fill aperture 222 so that it may not become dislodged in undesired situations and that fill plug 220, or any other plug described herein, can provide an air-tight and liquid-tight seal between the fuse box 200 and any outside elements. The fill coupling 230 may be disposed between the fill plug 220 and the fill aperture 222 and may couple the fill plug 220 into the fill aperture 222. The fill coupling 230 may further act to help secure fill plus 220 to fill aperture 222 and may also facilitate ease of adding liquid to the fuse box 200.

In further exemplary embodiment, the fuse holder 240 may be disposed within a bottom interior portion 210B of the base fuse box 210. The one or more fuses 250 may be secured within the base fuse box 210, in any known or desired fashion. For example, the one or more fuse link assemblies 260 may secure the one or more fuses 250 within the base fuse box 210.

Still referring to exemplary FIG. 2, three fuse link assemblies 260 may be shown, although it is appreciated that any number of fuse link assemblies may be present or utilized. The fuse holder 240 may couple the one or more fuse link assemblies 260 within the base fuse box 210. The one or more fuse link assemblies 260 may be coupled in a vertical, upright fashion within the base fuse box 210. The square gasket 270 may seal an opening 210C where the fuse holder 240 may be disposed. The square gasket 270 may be any type of gasket, as desired, and may act to provide an air-tight and liquid-tight seal. The fuse box cover 280 may be disposed in front of the square gasket 270 and may be coupled to a fuse box frame 210D to cover inside the base fuse box 210. The fuse box cover 280 may be coupled to the fuse box frame 210D with any number of fasteners 282, as desired, such as a number of removable screws (not shown) or the like.

Figure 3:
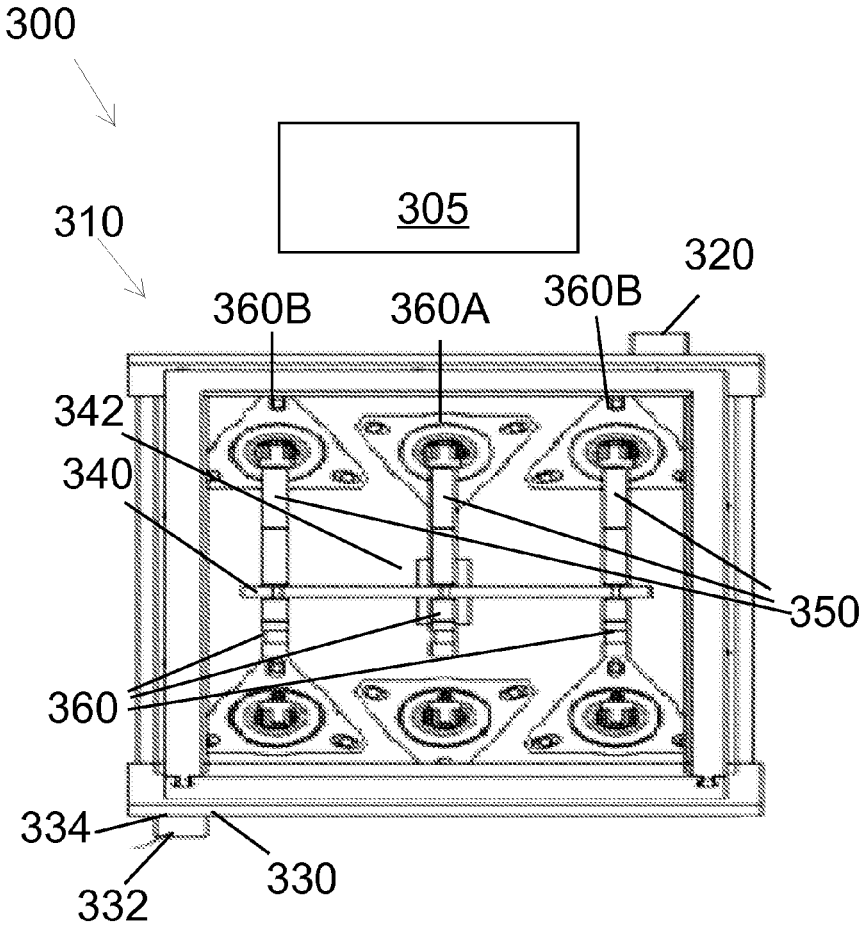
FIG. 3 is an exemplary diagram showing a front view of a fuse box mounted on a liquid-filled transformer.

FIG. 3 is an exemplary diagram showing a front view of a fuse box 300 mounted on a liquid-filled transformer 305.

Specifically, exemplary FIG. 3 is depicted with the fuse box cover (FIG. 2, 280) removed to illustrate inside of the fuse box 300.

The fuse box 300 may include a base fuse box 310, a fill aperture 320, an outlet aperture 330, a fuse holder 340, one or more fuses 350 and one or more fuse link assemblies 360, as well as any other desired components.

The base fuse box 310 may be mounted on the liquid-filled transformer 305 in any fashion, similar to that described above. The fill aperture 320 may receive fluid to be poured into the base fuse box 310, for example transformer oil or insulating oil. As described previously, the fill aperture may be located on a top portion of the base fuse box 310 so as to allow for ease of pouring liquid or fluid into the base fuse box 310. The outlet aperture 330 may allow fluid to exit from the base fuse box 310. The outlet aperture 330 may be located at a bottom portion of the base fuse box 310 so as to utilize gravity in removing, for example, contaminated fluid from the base fuse box 310. The outlet aperture 330 may be plugged with a drain plug 332 and the drain plug 332 may be coupled to the outlet aperture 330 with a drain coupling 334 in a fashion similar to that of the aperture 222 described above. The fuse holder 340 may be centered within a substantially middle portion 342 of the base fuse box 310. The one or more fuses 350 may be secured in a parallel orientation, or the like, across the base fuse box 310, as illustrated in exemplary FIG. 3. The one or more fuse link assemblies 360 may be secured in a parallel orientation, or the like, across the base fuse box 310, as illustrated in FIG. 3. The one or more fuse link assemblies 360 may include a middle fuse link assembly 360A and pair of end fuse link assemblies 360B. The middle fuse link assembly 360A may be flipped upside-down between the pair of end fuse link assemblies 360B disposed in an upright position or the like, as desired. Additionally, it is noted that the foregoing description and related figure is exemplary in nature; therefore, it can be appreciated that different orientations for mounting components in the fuse box 300 may be realized and implemented.

Figure 4:
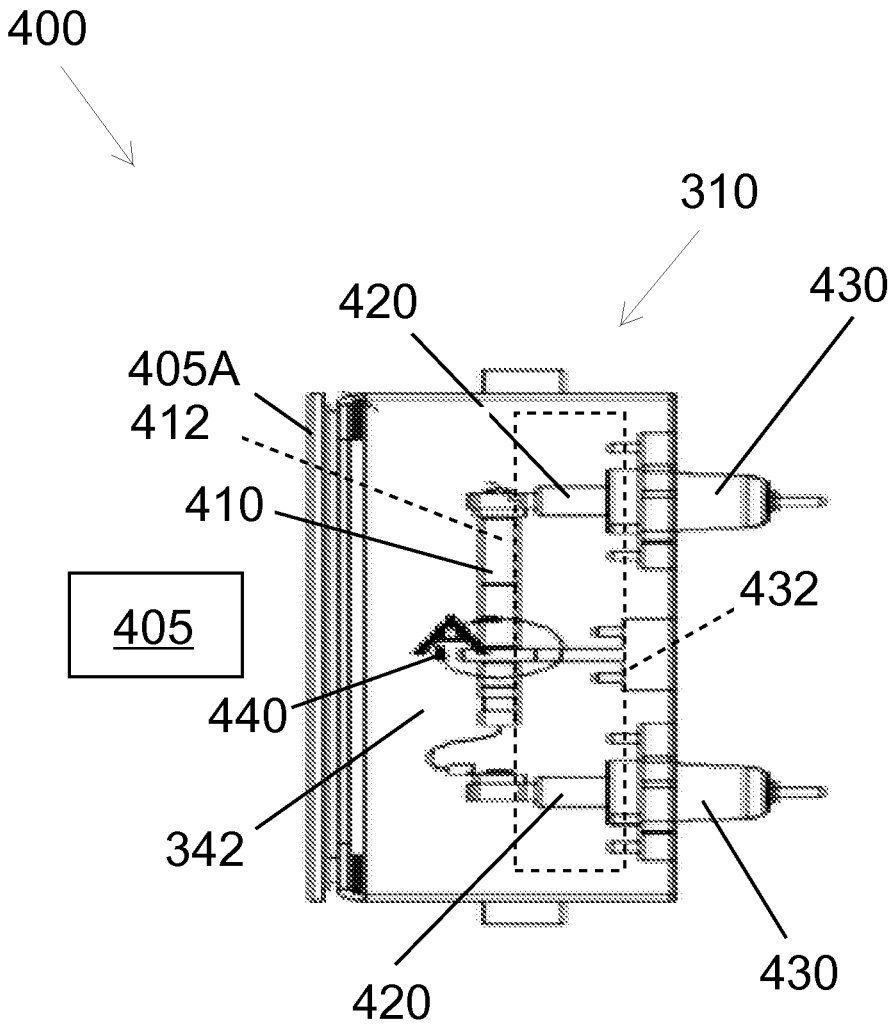
FIG. 4 is an exemplary diagram showing a side view of a fuse box mounted on a liquid-filled transformer.

FIG. 4 is an exemplary diagram showing a side view of a fuse box 400 mounted on a liquid-filled transformer 405 by a holder 405A. Specifically, FIG. 4 is depicted with a side fuse box cover (not shown) removed to illustrate inside of the fuse box 400.

The fuse box 400 may include a fuse holder 410, one or more fuse link assemblies 420, one or more fuses 430, and a retaining ring 440. The fuse holder 410 may be substantially centered within the middle portion 342 of the base fuse box 310. The fuse holder 410 may couple any number of fuse link assemblies 420 within the base fuse box 310, as desired. The fuse link assemblies 420 may secure the one or more fuses 430 within the base fuse box 310. The fuse link assemblies 420 may be pulled-up from the fuse holder 410 by hand, by tool, or any other manner, as desired, to remove the one or more fuse link assemblies 420 from the base fuse box 310 to provide a relatively easier way of removing the fuse link assemblies 420 than traditionally removing fuse link assemblies 420 with one or more tools (not shown) and the like. The fuses 430 (of which there may be any number) may then be removed from the removed fuse link assemblies 420 outside of the base fuse box 310 to change the fuses 430. The retaining ring 440 may fasten the fuse holder 410 to the fuse link assemblies 420. Further, the fuses 430 inside the fuse box 400 may be viewed via a window 432 disposed on the liquid-fill fuse box. The window 432 may allow for an inspection of the fuse box 310, and any internal components or fluids, to take place without physically removing the cover of the fuse box 310 or opening a door of the fuse box 310. Additionally, the window 432 may be formed out of any material, for example glass, a composite, or the like, which may allow for a viewer to view the inside of the fuse box 310 without any or significant contamination affecting the transparency of the window 432. The window 432 may also be mounted so as to provide an air-tight and a liquid-tight seal between inside the fuse box 310 and any outside elements.

In an exemplary embodiment, fuse box 400 may be externally mounted and may be the only part of a transformer (such as transformer 405) serviced when such a transformer is blown, for example when one or more fuses in the fuse box 400 fail or otherwise need servicing or replacement. The liquid or oil inside the transformer 405 tank may be uncontaminated due to the separation and seal between the transformer 405 and the fuse box 310. This may, further, eliminate a need or desire to disassemble, restore, and inspect the liquid-filled transformer 405 tank in the event of such a failure or need for servicing. As it may be sized significantly smaller than the transformer 405 tank, the fuse box 400 can also be liquid-filled and may only utilize a small fraction of the liquid replaced compared to the liquid in the entire transformer 405 tank. The liquid may further be drained very quickly and easily, for example through aperture 330, and fluid may be quickly and easily added to the fuse box 400, for example through aperture 320. By mitigating the risk of exposing the transformer liquid to contamination, the life of the transformer 405 can be extended by eliminating the need to refurbish the sealed transformer 405 tank, and servicing and repairs can be done more effectively and efficiently. Further, environmental concerns are mitigated as the amount of liquid that would need to be drained from a traditional transformer tank in the event of such service is significantly decreased, correspondingly decreasing the amount of liquid to be disposed of or recycled following such a service.

In such exemplary embodiments as shown and described herein, an orientation of a fuse box with respect to a liquid-filled transformer provides a dramatic improvement over the traditional method for servicing a fuse box on a liquid transformer. Traditionally, the fuses are mounted inside the liquid-filled tank and submerged in the liquid. In the event of a fuse failure, the transformer liquid is contaminated with carbon and other waste particles. As noted previously, replacing the fuses is expensive and takes many days due to the steps involved with disassembly and restoration.

Figure 5:
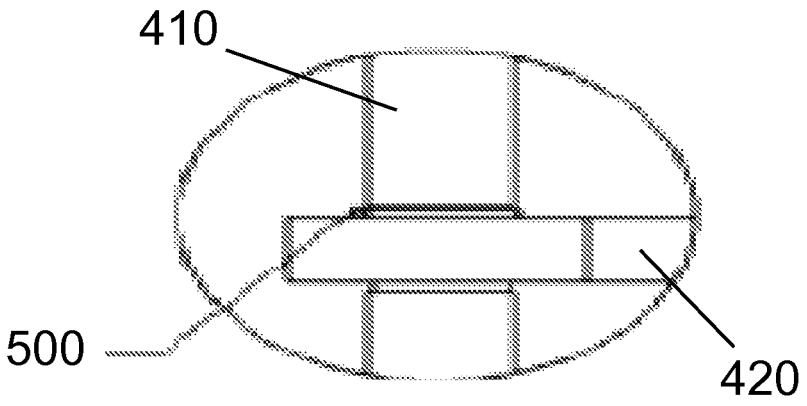
FIG. 5 is an exemplary diagram showing a side view of a retaining ring of a fuse box mounted on a liquid-filled transformer.

FIG. 5 is an exemplary diagram showing a side view of a retaining ring 500 of a fuse box mounted on a liquid-filled transformer.

The retaining ring 500 may provide a simplified, more effective manner of fastening the fuse holder 410 to the fuse link assemblies 420 than traditional fasteners. The retaining ring 500 may also allow for relatively easier fastening of the fuse holder 410 to the fuse link assemblies 420 than traditional fasteners.

Figure 6:
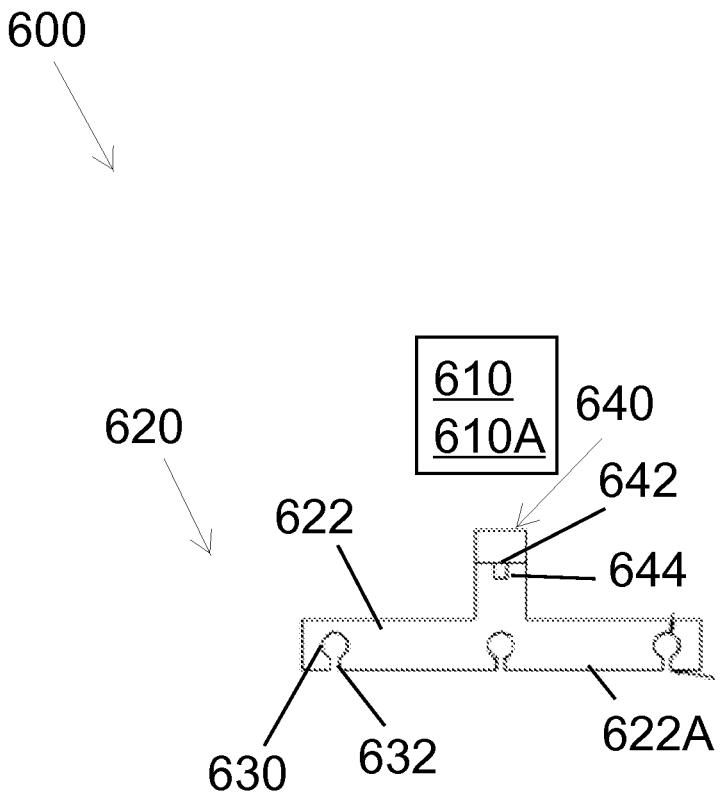
FIG. 6 is an exemplary diagram showing an overhead view of a holder coupled to a tank wall of a liquid-filled transformer.

FIG. 6 is an exemplary diagram showing an overhead view of a fuse holder 600 coupled to a tank wall 610A of a liquid-filled transformer 610. The holder 600 may couple a fuse box (see, for example, FIG. 4, 400) to the tank wall 610A of a liquid-filled transformer 610.

The holder 600 may include a generally t-shaped base 620, any number of apertures 630, and a mounting bracket 640. The generally t-shaped base 620 may be substantially planar, or the like. The apertures 630 may be disposed on a first planar portion 622 of the generally t-shaped base 620, or the like. The apertures 630 may have a slot 632 in communication with the apertures 630 to allow for lead entry into the apertures 630 from an outer edge 622A of the first planar portion 622 of the generally t-shaped base 620. The mounting bracket 640 may include any number of holes 642 disposed on the mounting bracket 640 to accommodate a fastener 644 such as a screw, a bolt or the like (all not shown) to secure the mounting bracket 640 to the tank wall 610A of a liquid-filled transformer 610.

Generally referring the figures, use of the fuse box (e.g. fuse box 210 of exemplary FIG. 2) described in various exemplary embodiments here may be straightforward. When a fuse, such as fuse 430, blows, only the fuse box 210 may need to be serviced. Servicing the mounted fuse box 210 may only utilize the limited steps of draining the liquid through an aperture 330 on a bottom of the liquid-filled fuse box 210, opening a front cover 280 of the liquid-filled fuse box 210 and cleaning an inside surface of the liquid-filled fuse box 210, replacing one or more fuses 430 of the liquid-filled fuse box 210, replacing the front cover 280, resealing the aperture 330, and refilling the fuse box 210 of the liquid-filled fuse box 210 with fresh liquid through an opening or aperture 222 on a top of the fuse box 210. The fuses inside the fuse box may be viewed via a window disposed on the fuse box 210 so as to provide with ease of inspection at any desired time without opening the fuse box 210 or draining the fluid therein. The method for servicing a fuse box on a liquid-filled transformer may be applied to new transformers or may be retrofitted to existing transformers being inspected, serviced or refurbished, as desired.

Thus, in exemplary embodiments shown and discussed herein, a liquid in a liquid-filled transformer may be uncontaminated when a fuse in an externally mounted fuse box fails or otherwise needs service or repair. The fuse box may be serviced faster and more efficiently than a traditional fuse box which is mounted inside of a liquid-filled transformer. A plurality of blown fuse metal fragments from the blown fuse box don't create a risk within the liquid-filled transformer because of the separation between the external fuse box and the liquid-filled transformer. Therefore, the liquid-filled transformer can last when the fuse box is externally mounted. Additionally, when the fuses inside the fuse box are viewed via a window in the fuse box, efficient inspection and assessment of the fuses, and other components of the fuse box, may easily be made without having to open the fuse box itself or drain the fluid therein. Further, as the fuse box is typically significantly smaller than a liquid-filled transformer onto which it may be mounted, only a small fraction of liquid compared is drained, recycled, disposed of, and replaced than that of the liquid-filled transformer.

The foregoing description and accompanying figures illustrate the principles, one or more embodiments and modes of operation of the present invention. However, the present invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments may be made by those skilled in the art without departing from the scope of the present invention as defined by the following claims.

What is claimed is:

1. A fuse box mounted on a liquid-filled transformer, comprising:

a base fuse box mounted on the liquid-filled transformer;

a fill plug removably inserted into a fill aperture disposed on a top portion of the base fuse box;

a fill coupling disposed between the fill plug and the fill aperture, the fill coupling couples the fill plug into the fill aperture, the fill aperture receives fluid poured into the base fuse box and an outlet aperture allows fluid to exit from the base fuse box, the outlet aperture is plugged with a drain plug;

a fuse holder disposed within a bottom interior portion of the base fuse box; one or more fuses secured within the base fuse box;

one or more fuse link assemblies that secure the one or more fuses within the base fuse box, the fuse holder coupling the one or more fuse link assemblies within the base fuse box, wherein the one or more fuse link assemblies are pulled upwards from the fuse holder to remove the one or more fuse link assemblies from the base fuse box;

a gasket sealing an opening where the fuse holder is disposed; and a fuse box cover disposed in front of the gasket, the fuse box cover and the gasket coupled to a fuse box frame to cover inside of the base fuse box, the fuse box cover and the gasket are coupled to the fuse box frame with a plurality of fasteners.

2. The fuse box according to claim 1, further comprising a retaining ring to fasten the fuse holder to the one or more fuse link assemblies.

3. The fuse box according to claim 1, wherein the drain plug is coupled to the outlet aperture with a drain coupling.

4. The fuse box according to claim 1, wherein the fuse holder is centered within a middle portion of the base fuse box.

5. The fuse box according to claim 1, wherein the one or more fuses are secured in a parallel orientation across the base fuse box.

6. The fuse box according to claim 1, wherein the one or more fuse link assemblies are coupled vertically upright within the base fuse box.

7. The fuse box according to claim 1, wherein the fuse box is externally mounted on the liquid-filled transformer.

* * * * *